US010880638B2

(12) United States Patent
Maeno et al.

(10) Patent No.: US 10,880,638 B2
(45) Date of Patent: Dec. 29, 2020

(54) SOUND FIELD FORMING APPARATUS AND METHOD

(71) Applicant: SONY CORPORATION, Tokyo (JP)

(72) Inventors: Yu Maeno, Tokyo (JP); Yuhki Mitsufuji, Tokyo (JP); Masafumi Takahashi, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/314,280

(22) PCT Filed: Jun. 21, 2017

(86) PCT No.: PCT/JP2017/022774
§ 371 (c)(1),
(2) Date: Dec. 28, 2018

(87) PCT Pub. No.: WO2018/008396
PCT Pub. Date: Jan. 11, 2018

(65) Prior Publication Data

US 2019/0230435 A1 Jul. 25, 2019

(30) Foreign Application Priority Data

Jul. 5, 2016 (JP) ..... 2016-133050

(51) Int. Cl.
*H04R 25/00* (2006.01)
*H04R 1/40* (2006.01)
(Continued)

(52) U.S. Cl.
CPC ..... *H04R 1/403* (2013.01); *H04R 3/00* (2013.01); *H04S 7/303* (2013.01); *H04S 2400/11* (2013.01); *H04S 2420/13* (2013.01)

(58) Field of Classification Search
CPC ..... H04R 1/403; H04R 3/00; H04S 2400/11; H04S 2420/13; H04S 7/303
(Continued)

(56) References Cited

U.S. PATENT DOCUMENTS 7,783,047 B2 * 8/2010 Miura ..... H04R 3/12 381/17
7,978,860 B2 * 7/2011 Miura ..... H04R 5/04 381/1
(Continued)

FOREIGN PATENT DOCUMENTS

CN 104469491 A 3/2015
CN 105723743 A 6/2016
(Continued)

OTHER PUBLICATIONS

Ahrens, et al., "Sound Field Reproduction Using Planar and Linear Arrays of Loudspeakers", IEEE Transactions on Audio, Speech, and Language Processing, vol. 18, Issue 8, Nov. 2010, 2038-2050 pages.
(Continued)

*Primary Examiner* — Phylesha Dabney
(74) *Attorney, Agent, or Firm* — Chip Law Group

(57) ABSTRACT

Provided are a sound field forming apparatus and a method that enhances the reproducibility of a wavefront at a listener position. The sound field forming apparatus has a position acquisition unit to acquire position information indicative of a position of a listener or a position of a sound source to be formed, a control point specification unit to specify a control point with a distance from a speaker array of the listener or the sound source on the basis of the position information, and a filter unit to generate a speaker drive signal for forming a predetermined sound field by the speaker array by convoluting a filter coefficient corresponding to the specified control point with a sound source signal.

10 Claims, 9 Drawing Sheets

(51) Int. Cl.
*H04S 7/00* (2006.01)
*H04R 3/00* (2006.01)

(58) Field of Classification Search
USPC ..... 381/182
See application file for complete search history.

(56) References Cited

U.S. PATENT DOCUMENTS

| | | | | |
|---|---|---|---|---|
| 8,223,992 | B2 * | 7/2012 | Suzuki | H04R 1/403 381/1 |
| 8,428,268 | B2 * | 4/2013 | Konagai | H04R 25/45 381/17 |
| 9,219,974 | B2 * | 12/2015 | Ko | H04S 7/302 |
| 10,264,383 | B1 * | 4/2019 | Johnson | H04R 5/04 |
| 10,334,389 | B2 * | 6/2019 | Miyasaka | G10K 15/08 |
| 10,484,812 | B2 * | 11/2019 | Matsumura | H04R 5/04 |
| 2008/0226084 | A1 * | 9/2008 | Konagai | H04S 3/008 381/17 |
| 2009/0010455 | A1 * | 1/2009 | Suzuki | H04R 1/403 381/97 |
| 2009/0304211 | A1 * | 12/2009 | Tashev | H04R 3/12 381/182 |
| 2012/0014525 | A1 * | 1/2012 | Ko | H04S 7/302 381/17 |
| 2015/0078595 | A1 | 3/2015 | Shintani et al. | |
| 2016/0269848 | A1 | 9/2016 | Mitsufuji et al. | |
| 2016/0295340 | A1 | 10/2016 | Baker et al. | |
| 2016/0295342 | A1 * | 10/2016 | Miyasaka | G10K 15/08 |
| 2019/0230435 | A1 * | 7/2019 | Maeno | H04R 1/403 |
| 2019/0327573 | A1 * | 10/2019 | Maeno | H04R 1/403 |

FOREIGN PATENT DOCUMENTS

| | | | |
|---|---|---|---|
| EP | 3073766 | A1 | 9/2016 |
| EP | 3467818 | A1 | 4/2019 |
| JP | 2015-056905 | A | 3/2015 |
| KR | 10-2015-0031179 | A | 3/2015 |
| KR | 10-2016-0086831 | A | 7/2016 |
| WO | 2013/042324 | A1 | 3/2013 |
| WO | 2015/076149 | A1 | 5/2015 |
| WO | 2015/076930 | A1 | 5/2015 |

OTHER PUBLICATIONS

Ahrens, et al., "Sound Field Reproduction Using Planar and Linear Arrays of Loudspeakers", IEEE Transactions on Audio, Speech, and Language processing, vol. 18, No. 8, Nov. 2010, pp. 2038-2050.

International Search Report and Written Opinion of PCT Application No. PCT/JP2017/022774, dated Sep. 19, 2017, 09 pages of ISRWO.

Extended European Search Report of EP Application No. 17824003.2, dated Jun. 3, 2019, 07 pages.

* cited by examiner

SOUND FIELD FORMING APPARATUS AND METHOD

CROSS REFERENCE TO RELATED APPLICATIONS

This application is a U.S. National Phase of International Patent Application No. PCT/JP2017/022774 filed on Jun. 21, 2017, which claims priority benefit of Japanese Patent Application No. JP 2016-133050 filed in the Japan Patent Office on Jul. 5, 2016. Each of the above-referenced applications is hereby incorporated herein by reference in its entirety.

TECHNICAL FIELD

The present technology relates to a sound field forming apparatus and method and a program and, more particularly, to a sound field forming apparatus and method and a program that are configured to enhance the reproducibility of the wavefront at a listener position.

BACKGROUND ART

For example, in a case where there are two or more listeners in a space and it is desired to have each of these listeners listen to a desired sound, use of a directivity control technology allows each listener to listen to a sound different from those of other listeners.

For the method of executing such directivity control, a method of using parametric speakers is known. However, the method of using parametric speakers requires to prepare the number of parametric speakers by the number of directions of presented sounds and, at the same time, disables the forming of particular sound fields such as point sound sources and plane waves. Further, as generally compared with normal speakers, the tone quality of the sound outputted from parametric speakers is not good, thereby limiting the types of content to be reproduced.

By contrast, use of a wavefront synthesis technology allows the formation of point sound sources and plane waves, thereby providing particular listeners with desired sound fields.

For example, in the case of sound field forming by use of a speaker array, there exists a control line including a control point group called a reference line parallel to the direction of the arrangement of the speakers making up the speaker array. Then, it is known that the formed sound field can be matched with an ideal sound field only on these control points (refer to NPL 1, for example).

CITATION LIST

Non-Patent Literature

[NPL 1]
Jens Ahrens, Sascha Spors, "Sound Field Reproduction Using Planar and Linear Arrays of Loudspeakers," IEEE TRANSACTIONS ON AUDIO, SPEECH, AND LANGUAGE PROCESSING, 2010.

SUMMARY

Technical Problems

Since the sound field forming technology using a speaker array forms a desired sound field in a region on the far side from the reference line as seen from the speaker array, namely, a region behind the reference line, a listener must be positioned behind the control points. Further, the farther away from the control points, the lower gets the reproducibility of the wavefront of sound. That is, as a position gets farther away from the control points, an error between a formed sound field and a targeted ideal sound field gets greater.

Hence, in a case where it is required to have two or more listeners listen to different sounds by forming a sound field through a speaker array and the listeners are at positions different in the distance from the speaker array, then it is difficult to form a sound field having a small error from an ideal sound field at these positions of the respective listeners.

To be more specific, in a case where there are two or more listeners, for example, then each listener has to be positioned behind the control point. Further, even if a fixed control point is set for one listener, that fixed control point is not always an optimum one for other listeners, thereby lowering the reproducibility of the wavefront at the position of the listener far from the control point.

Therefore, the present technology addresses the above-identified and other problems and solves the addressed problems by enhancing the reproducibility of the wavefront at each listener position.

Solution to Problems

A sound field forming apparatus according to an aspect of the present technology has a position acquisition unit configured to acquire position information indicative of a position of a listener or a position of a sound source to be formed, a control point specification unit configured to specify a control point in accordance with a distance from a speaker array of the listener or the sound source on the basis of the position information, and a filter unit configured to generate a speaker drive signal for forming a predetermined sound field by the speaker array by convoluting a filter coefficient corresponding to the specified control point with a sound source signal.

The control point specification unit can be made specify the control point in accordance with a distance from the speaker array of the listener for each of a plurality of the listeners.

The control point specification unit can be made specify the control point in accordance with a distance from the speaker array of the listener nearest from the speaker array among a plurality of the listeners.

The control point specification unit can be made specify the control point by switching between the specification of the control point for each of the plurality of listeners on the basis of the position information and the specification of the control point in accordance with a distance from the speaker array of the listener nearest from the speaker array among the plurality of listeners.

In a case where a distance between the plurality of listeners is equal to or less than a predetermined threshold value, the control point specification unit can be made specify the control point in accordance with a distance from the speaker array of the listener nearest from the speaker array among the plurality of listeners.

The speaker array can be arranged so as to surround the listener.

The sound field forming apparatus can further have the speaker array.

The sound field forming apparatus can further have a filter coefficient recording unit configured to record each of the filter coefficients corresponding to each of a plurality of the control points.

From among the filter coefficients of speakers making up the speaker array corresponding to the specified control point, the filter unit can be made generate the speaker drive signal by use of only the filter coefficient of a speaker in accordance with the position of the sound source or the position of the listener.

A sound field forming method or a program according to an aspect of the present technology includes the steps of: acquiring position information indicative of a position of a listener or a position of a sound source to be formed; specifying a control point in accordance with a distance from a speaker array of one of the listener and the sound source on a basis of the position information; and generating a speaker drive signal for forming a predetermined sound field by the speaker array by convoluting a filter coefficient corresponding to the specified control point with a sound source signal.

In one aspect of the present technology, position information indicative of a position of a listener or a position of a sound source to be formed is acquired, a control point is specified in accordance with a distance from a speaker array of the listener or the sound source on the basis of the position information, and a speaker drive signal for forming a predetermined sound field by the speaker array is generated by convoluting a filter coefficient corresponding to the specified control point with a sound source signal.

Advantageous Effects of Invention

According to one aspect of the present technology, the reproducibility of the wavefront at a listener position can be enhanced.

It should be noted that the effects described here are not restrictive, so that any other effects described in the present disclosure are valid.

DESCRIPTION OF EMBODIMENTS

The following describes embodiments to which the present technology is applied with reference to drawings.

A First Embodiment

<The Present Technology>

The present technology is configured to specify (or set), by use of a speaker array, the position in the depth direction of a listener as viewed from the speaker array and control points in accordance with the position of a generated sound source so as to execute wavefront synthesis, thereby enhancing the reproducibility of the wavefront of sound at each listener position.

Figure 1:
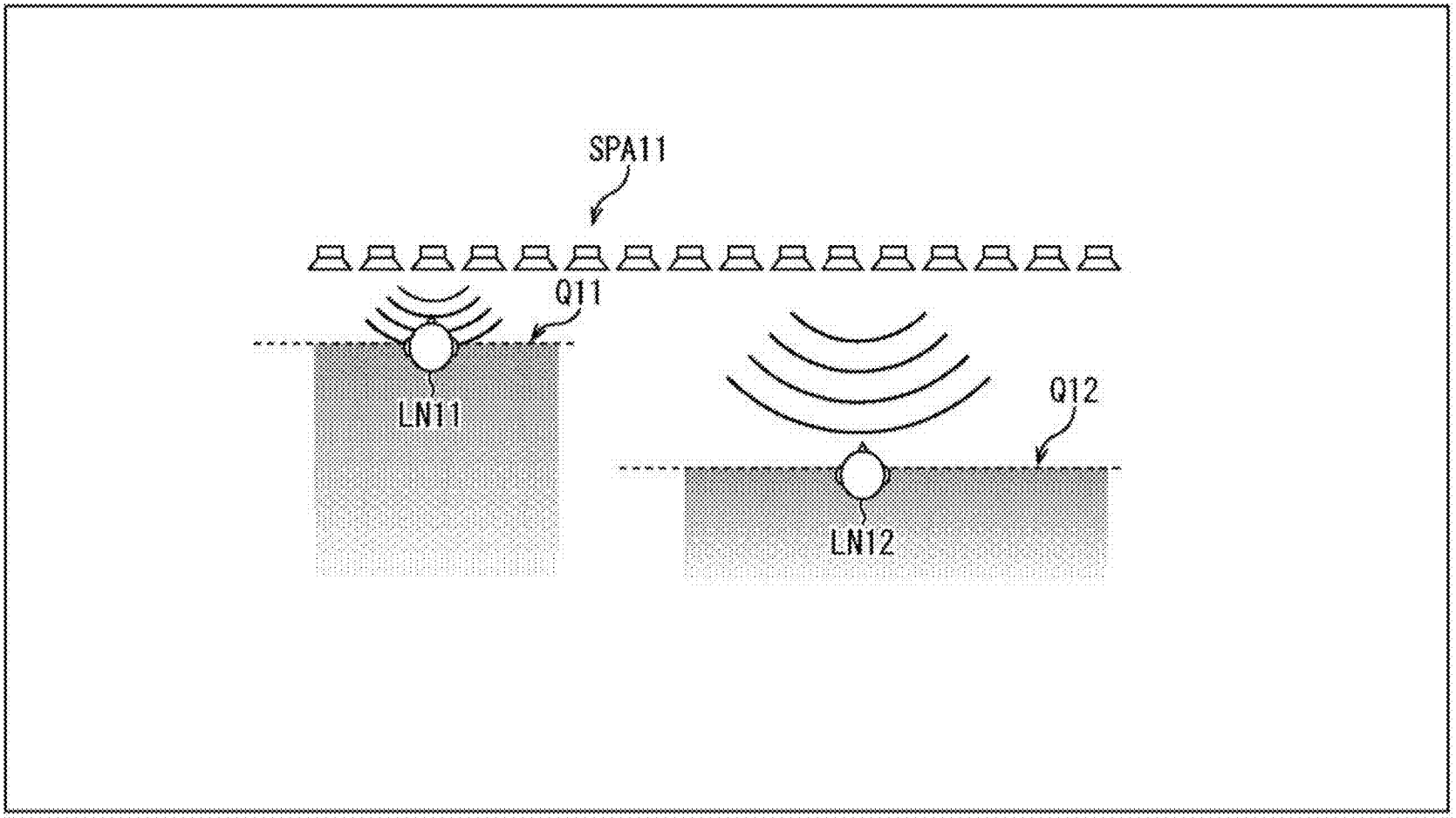
FIG. 1 is a diagram describing an overview of the present technology.

As depicted in FIG. 1, for example, it is assumed that a speaker array SPA11 provided by two or more speakers in a linear manner form a sound field.

This example also assumes that there be two listeners LN11 and LN12 in front of the speaker array SPA11 to let each of these listeners LN11 and LN12 listen to a different sound. In the diagram, the downward direction, namely, the direction vertical to the direction in which the speakers making up the speaker array SPA11 are arranged is also referred to as the depth direction.

At this moment, let a reference line be at a position indicated by arrow Q11 for a sound to be listened to by each listener, a sound field matching an ideal sound field can be presented to the listener LN11. However, since the listener LN12 is at a position far from the reference line in the depth direction, a sound field to be presented to the listener LN12 has a large error with an ideal sound field.

On the other hand, let the reference line be at a position indicated by arrow Q12 for a sound to be listened to by each listener, then a sound field matching an ideal sound field can be presented to the listener LN12; however, the listener LN11 comes to be positioned on the side of the speaker array SPA11 relative to the reference line. As a result, no proper sound field can be presented to the listener LN11.

Therefore, the present technology is configured to enhance the reproducibility of the wavefront by a formed sound field at the position of each listener by specifying two or more control points, namely, two or more reference lines, mutually different in positions in the depth direction in accordance with a position in the depth direction of each listener and a position of a sound source to be generated.

In the example illustrated in FIG. 1, for example, for a sound to be listened to by the listener LN11, a position in the depth direction indicated by arrow Q11 is specified as the position of control points, namely, the position of the reference line, thereby generating a speaker drive signal. Further, for a sound to be listened to by the listener LN12, a position in the depth direction indicated by arrow Q12 is specified as the position of control points, thereby generating a speaker drive signal. Then, these two speaker drive signals are added together to provide a final speaker drive signal.

As described above, specifying two or more reference lines for each listener, for example, allows the forming of a sound field having less error at the position of each listener, eventually enhancing the reproducibility of wavefront.

<Configurational Example of the Sound Field Forming Apparatus>

The following describes, in more detail, a configurational example of one embodiment of a sound field forming apparatus to which the present technology is applied.

Figure 2:
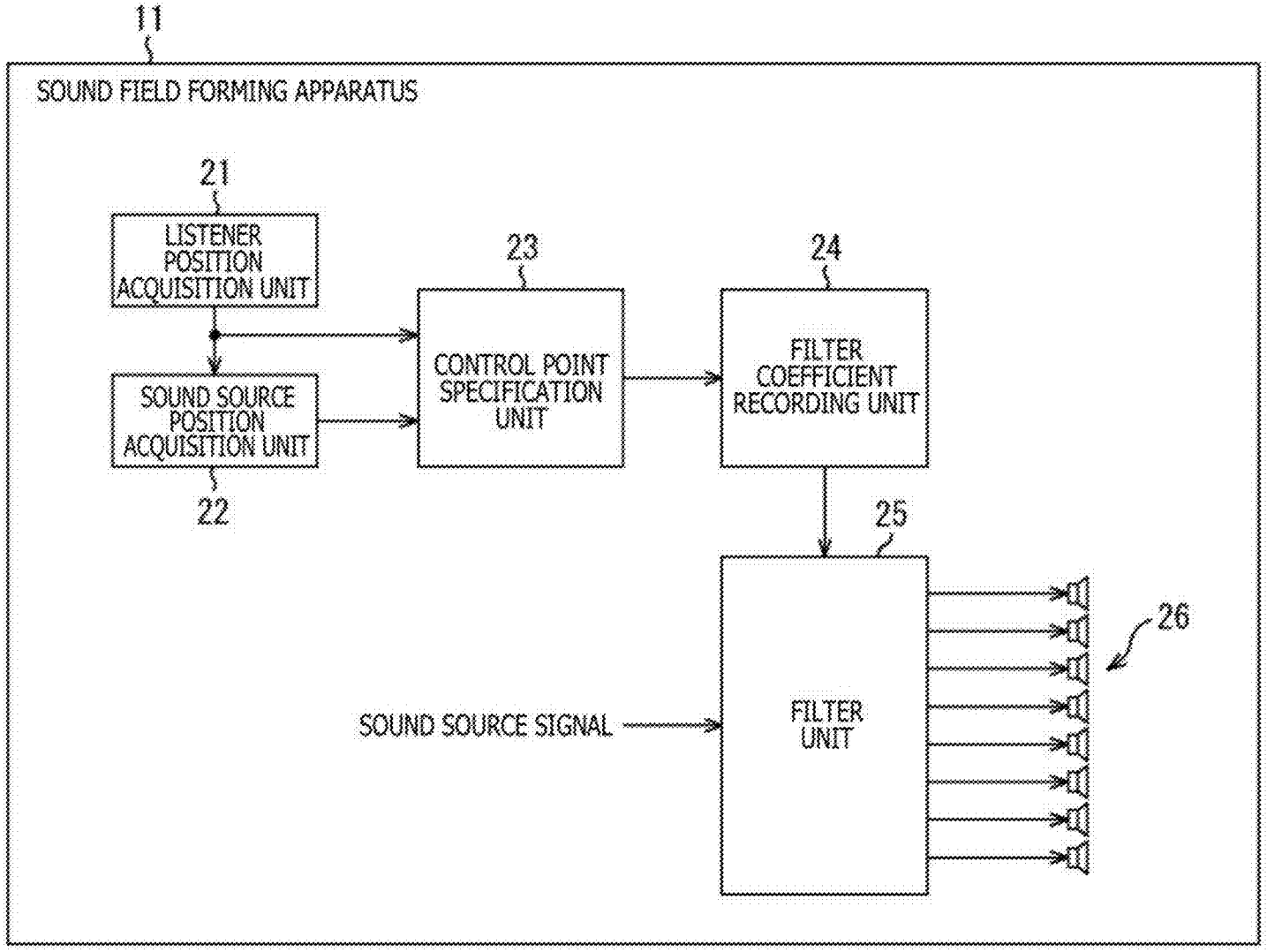
FIG. 2 is a diagram illustrating a configurational example of a sound field forming apparatus.

FIG. 2 is a diagram illustrating a configurational example of the sound field forming apparatus to which the present technology is applied practiced as one embodiment.

A sound field forming apparatus 11 illustrated in FIG. 2 has a listener position acquisition unit 21, a sound source position acquisition unit 22, a control point specification unit 23, a filter coefficient recording unit 24, a filter unit 25, and a speaker array 26.

The listener position acquisition unit 21 acquires listener position information indicative of the position of a listener in a listening area that is a space forming a sound field and supplies the acquired listener position information to the sound source position acquisition unit 22 and the control point specification unit 23.

The sound source position acquisition unit 22 uses, as required, the listener position information supplied from the listener position acquisition unit 21 so as to acquire the sound source position information indicative of the position of a point sound source generated by forming a sound field and supply the acquired sound source position information to the control point specification unit 23.

On the basis of at least one of the listener position information supplied from the listener position acquisition unit 21 and the sound source position information supplied from the sound source position acquisition unit 22, the control point specification unit 23 generates control point information for specifying the position of control points in forming a sound field and supplies the generated control point information to the filter coefficient recording unit 24.

For example, in the control point specification unit 23, two or more control points mutually different in the distance in the depth direction from the speaker array 26 are specified, thereby generating the control point information indicative of the positions of these control points.

The filter coefficient recording unit 24 records the filter coefficient of an audio filter for forming a sound field by wavefront synthesis for each position of a reference line in the depth direction, namely, for each position in the depth direction of control points.

The filter coefficient recording unit 24 selects, from among the filter coefficients recorded in advance, a filter coefficient corresponding to the control point position indicated by the control point information supplied from the control point specification unit 23 and supplies the selected filter coefficient to the filter unit 25. Therefore, in a case where two or more control points different in the position in the depth direction are specified by the control point information, a filter coefficient is selected for each of these control points.

To the filter unit 25, the sound source signal of a sound to be reproduced is supplied. The filter unit 25 convolves an externally supplied sound source signal with a filter coefficient supplied from the filter coefficient recording unit 24 to obtain a speaker drive signal for forming a predetermined sound field and supplies the obtained speaker drive signal to the speaker array 26.

To be more detail, the filter unit 25 generates a speaker drive signal for each control point specified by the control point information, namely, for each supplied filter coefficient and adds these speaker drive signals together, thereby generating a final speaker drive signal.

It should be noted that, for example, in a case of having each listener existing in a listening area listen to the sound of a different piece of content, a sound source signal for reproducing the content sound is supplied to the filter unit 25 for each piece of content. Further, for example, in a case of having two or more listeners listen to a sound of the same content with a different timing, a sound source signal for reproducing that one piece of content is supplied to the filter unit 25.

The speaker array 26 includes a linear speaker array with two or more speakers arranged in a linear manner, a planar speaker array with two or more speakers arranged in a planar manner, a ring speaker array with two or more speakers arranged in a circular manner, or a spherical speaker array with two or more speakers arranged in a spherical manner, for example.

The speaker array 26 forms a sound field by reproducing a sound on the basis of a speaker drive signal supplied from the filter unit 25.

Figure 3:
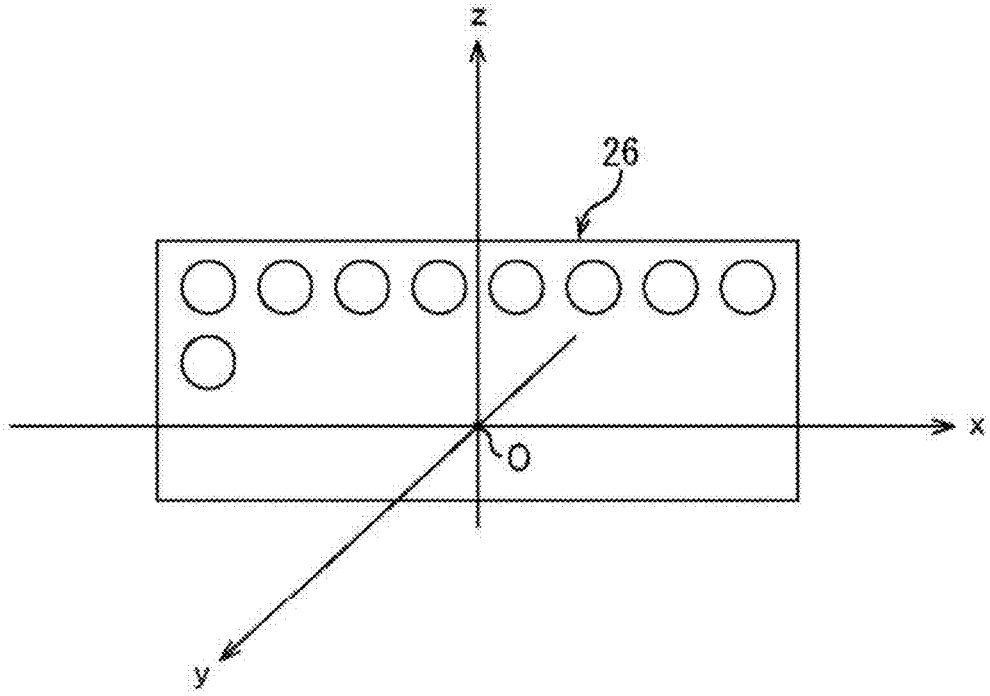
FIG. 3 is a diagram describing a coordinate system.

The following describes a coordinate system to be explained below with reference to FIG. 3. It should be noted that, with reference to FIG. 3, components similar to those previously described with reference to FIG. 2 are denoted by the same reference symbols and the description thereof will be skipped.

That is, in the following description, the center position of the speaker array 26 is origin O of a three-dimensional orthogonal coordinate system.

The three axes of a three-dimensional orthogonal coordinate system are the x-axis, the y-axis, and the z-axis that pass origin O at right angles to each other. It should be noted that the direction of the x-axis, namely, the x direction is the direction in which the speakers making up the speaker array 26 are arranged. The direction of the y-axis, namely, the y direction is the direction vertical to the x direction and in parallel to the direction in which a sound wave is outputted from the speaker array 26. The direction vertical to these x direction and y direction is the direction of the z-axis, namely, the z direction. Especially, the direction in which a sound wave is outputted from the speaker array 26 is the positive direction of the y direction.

In what follows, a position in the space, namely, a vector indicative of a position in the space is also referred to as (x, y, z) by use of the x-coordinate, the y-coordinate, and the z-coordinate. In addition, a position indicated by coordinates (x, y, z) is also referred to as position v.

Further, the speaker array 26 may be any one of a linear speaker array, a planar speaker array, a ring speaker array, a spherical speaker array, and so on; in what follows, however, the speaker array 26 is assumed to be a linear speaker array.

In this case, since the positions in the y direction of two or more control points making up one reference line that is specified for the speaker array 26 are the same, the reference line becomes a straight line having a constant distance in the y direction, namely, the distance in the depth direction from the speaker array 26. That is, the reference line becomes a straight line parallel to the x direction.

<The Listener Position Acquisition Unit>

The following describes, in more detail, each of the units of the sound field forming apparatus 11 illustrated in FIG. 2. First, the listener position acquisition unit 21 is described.

The listener position acquisition unit 21 acquires distance $y_{lsn}$ in the y direction from the speaker array 26 to a listener as listener position information, for example.

For example, it is also practicable for the listener position acquisition unit 21 to acquire distance $y_{lsn}$ supplied from an external apparatus or inputted by a user or the like as listener position information.

Further, for example, it is also practicable for the listener position acquisition unit 21 to compute distance $y_{lsn}$ for each listener by detecting the number of listeners and the positions thereof, thereby acquiring distance $y_{lsn}$ as listener position information.

In such a case, the listener position acquisition unit 21 includes a camera for taking an image of a listener as a subject, a pressure-sensitive sensor, arranged on the floor portion of a space in which a listener is positioned, and a distance sensor for detecting a distance up to a listener by ultrasonic wave, for example. In this case, the listener position acquisition unit 21 recognizes a listener by use of such as the camera, the pressure-sensitive sensor, or the distance sensor so as to compute distance $y_{lsn}$ on the basis of an obtained recognition result.

To be more specific, the listener position acquisition unit 21 detects a listener from the image taken with the camera by the object recognition using a dictionary, for example, and computes, as distance $y_{lsn}$, the distance from the speaker array 26 to the listener in the y direction in the space for each listener on the basis of the result of the detection, for example.

It should be noted that, in a case where the distance between two or more listeners in the y direction is nearer than a predetermined constant distance, then these listeners may be processed as one group. In this case, distance $y_{lsn}$ of the listener nearest from the speaker array 26 in the y direction or distance $y_{lsn}$ of the typical listener belonging to the groups, for example, becomes the listener position information when this group is regarded as one listener.

Further, the listener position information may include not only the position of each listener in the y direction but also the positions of each listener in the x direction and the z direction.

(The Sound Source Position Acquisition Unit)

The sound source position acquisition unit 22 acquires the position of a point sound source as sound source position information in a case of generating the point sound source by use of SDM (Spectral Division Method), for example, to be described later.

For example, a sound source position may be determined from a relative positional relation with a listener by use of the listener position information supplied from the listener position acquisition unit 21 or the absolute position of a point sound source inputted from the outside may be determined.

To be more specific, in a case where the position of generation of a point sound source as seen from a listener is determined in advance, for example, the position of the point sound source is determined from the position of the listener indicated by listener position information and the information indicative of the determined position provides sound source position information.

It should be noted that, since the position of the y direction of a point sound source generated at forming a sound field cannot be set to a position farther from the speaker array 26 than the position of a listener, if the position in the y direction of the point sound source is farther from the speaker array 26 than the listener, such a position of the point sound source is not employed. Further, in such a case, the position of the y direction of the point sound source may be corrected within the position of the listener, namely, to the position on the side of the speaker array 26 rather than the position of the listener.

(The Control Point Specification Unit)

The control point specification unit 23 specifies a control point position in forming a sound field on the basis of at least one of listener position information and sound source position information. That is, the control point information indicative of the control point position determined in accordance with a distance of a listener or a sound source in the y direction from the speaker array 26 is generated.

Figure 4:
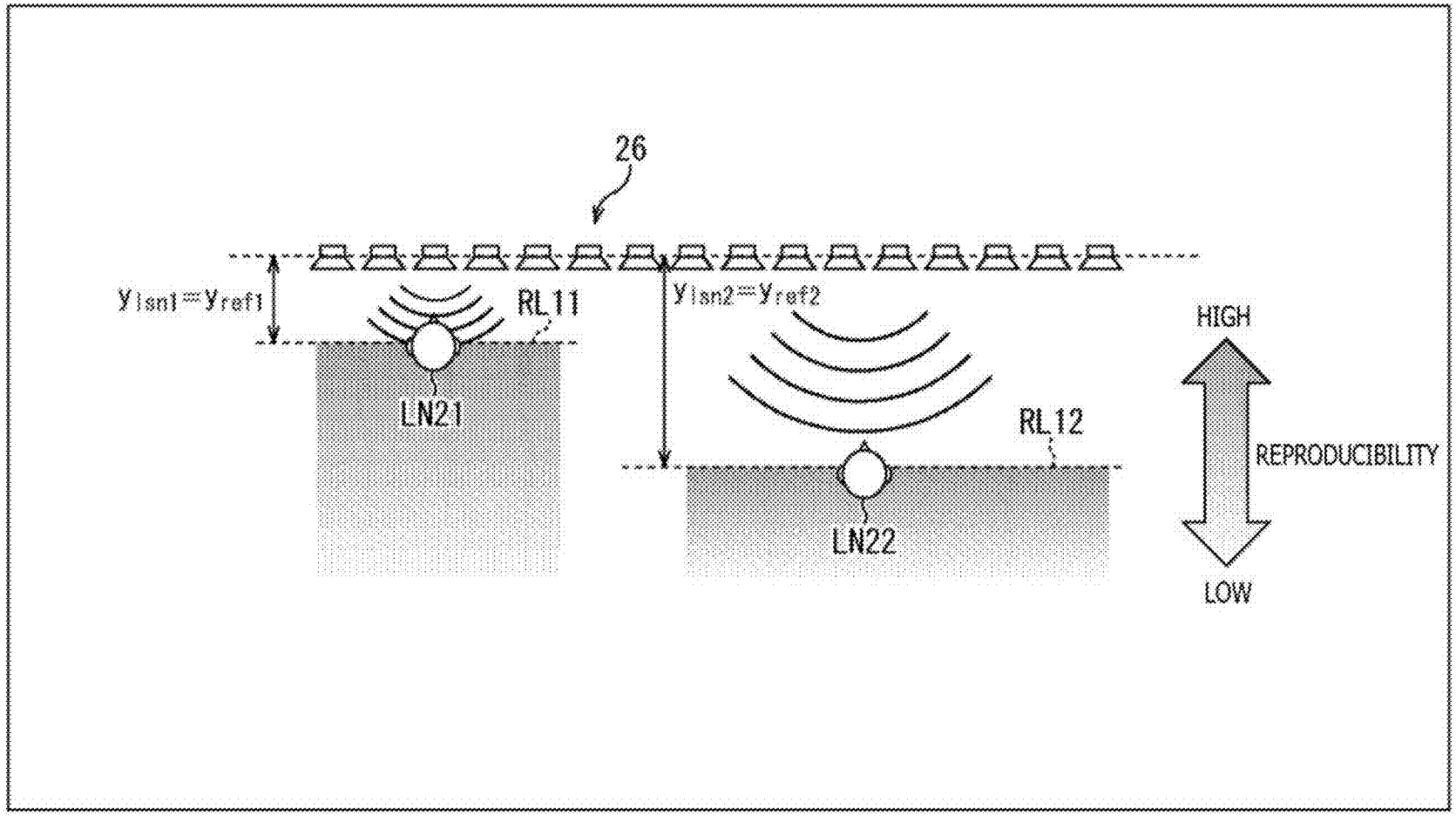
FIG. 4 is a diagram describing a method of specifying control points.

To be more specific, a distance from the speaker array 26 to the depth direction of each listener, namely, the distance in the y direction is the distance up to the control point as illustrated in FIG. 4, for example. It should be noted that, with reference to FIG. 4, components similar to those previously described with reference to FIG. 2 are denoted by the same reference symbols and the description thereof will be skipped.

In the example illustrated in FIG. 4, one listener LN21 is at a position in which a distance in the y direction relative to the speaker array 26 is $y_{lsn1}$, namely, a distance in which the position in the y direction is $y=y_{lsn1}$. In addition, one listener LN22 is at a position in which a distance in the y direction relative to the speaker array 26 is $y_{lsn2}$, namely, a distance in which the position in the y direction is $y=y_{lsn2}$.

For example, the control point specification unit 23 sets the position of $y=y_{lsn1}$ in which the listener LN21 exists as the position $y=y_{ref1}$ of the first control point, namely, the position of reference line RL11. Further, the control point specification unit 23 sets the position of $y=y_{lsn2}$ in which the listener LN22 exists as the position $y=y_{ref2}$ of the second control point, namely, the position of reference line RL12.

Then, the control point specification unit 23 generates, as control point information, the information indicative of the control point position, namely, the information indicative of distance $y_{ref1}$ and distance $y_{ref2}$.

In this case, distance $y_{lsn}=y_{lsn1}$ indicative of the position of the listener LN21 indicated by listener position information becomes distance $y_{ref1}$ indicative of the control point position on the reference line RL11 without change. Likewise, distance $y_{lsn}=y_{lsn2}$ indicative of the position of the listener LN22 indicated by listener position information becomes distance $y_{ref2}$ indicative of the position of each control point on the reference line RL12 without change.

In a case where two or more listeners are detected as described above, let the position of the y direction of each listener be the position of the control point in the y direction, then the reproducibility of the wavefront at the positions of all listeners can be enhanced at forming a sound field. That is, at the position of each listener, a good wavefront having less error with an ideal wavefront can be formed. This is, as described above, because the reproducibility of a formed wavefront gets higher as the position gets nearer to the control points, namely, the reference line.

In what follows, the control point specification method with the position of each listener being the control point position is especially referred to also as a listener-by-listener control point specification method.

Figure 5:
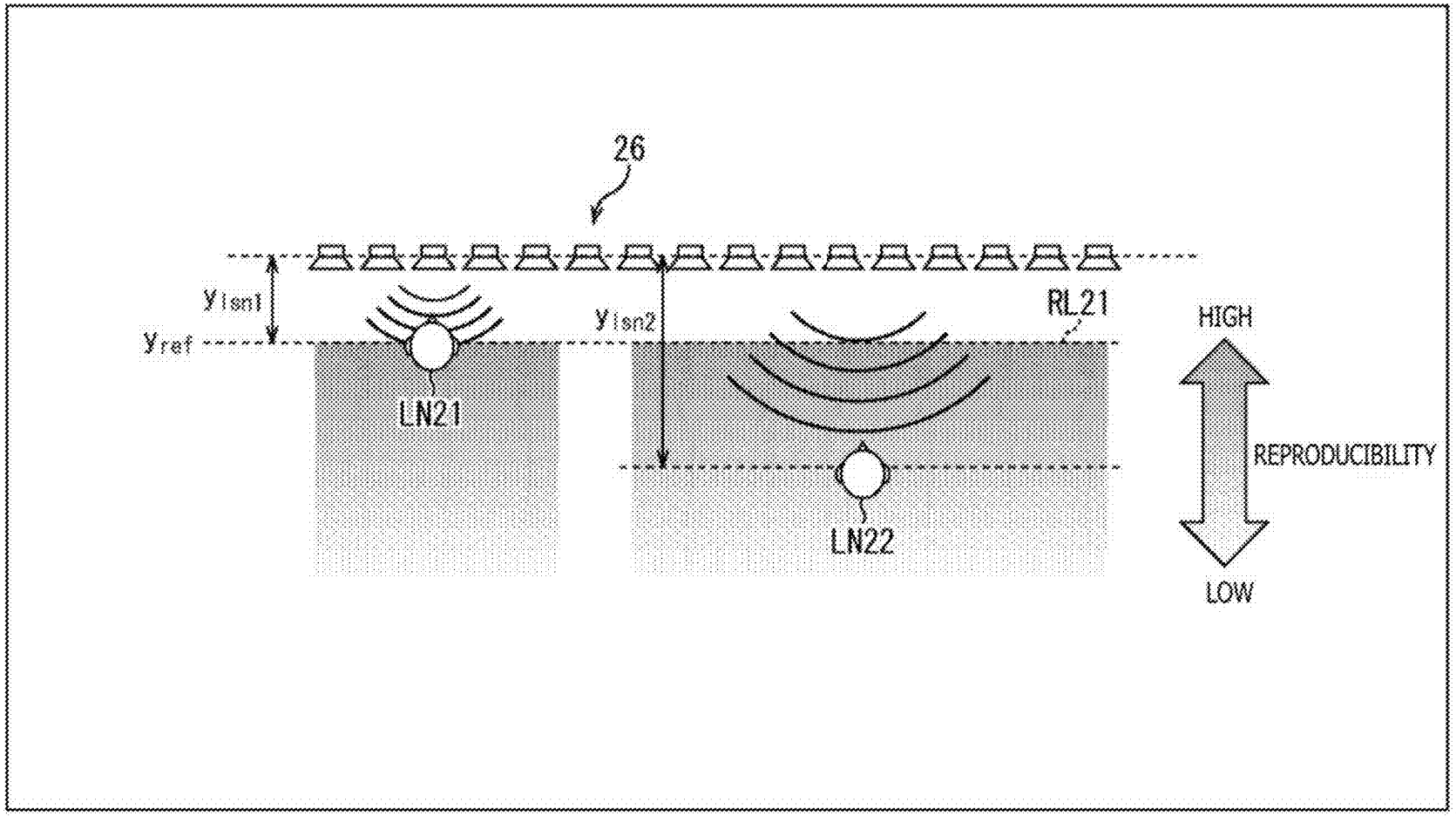
FIG. 5 is a diagram describing another method of specifying control points.

Further, let one listener LN21 be at a position with a distance in the y direction being $y_{lsn1}$ relative to the speaker array 26 and one listener LN22 be at a position with a distance in the y direction relative to the speaker array 26 being $y_{lsn2}$ as illustrated in FIG. 5, for example. It should be noted that, with reference to FIG. 5, components similar to those previously described with reference to FIG. 4 are denoted by the same reference symbols and the description thereof will be skipped.

In this case, of the two listeners LN21 and LN22, the control point specification unit 23 specifies the position of the listener with the distance in the y direction nearest to the speaker array 26 as the control point position, namely, the position of the reference line.

In other words, of distance $y_{lsn1}$ from the speaker array 26 to the listener LN21 and distance $y_{lsn2}$ from the speaker array 26 to the listener LN22, the shortest distance, namely, the distance having the smallest value provides the distance in the y direction indicative of the control point position.

In this example, of distance $y_{lsn1}$ and distance $y_{lsn2}$, the smaller distance $y_{lsn1}$ is specified as control point position $y=y_{ref}$, namely, the position of the reference line RL21. Each control point on this reference line RL21 is a control point of a sound field for reproducing a sound to be listened to by the listener LN21 as well as a control point of a sound field for reproducing a sound to be listened to by the listener LN22.

The control point specification unit 23 generates, as control point information, the information indicative of the control point position $y=y_{ref}$ determined as described above.

In this case, of distance $y_{lsn}=y_{lsn1}$ indicative of the position of the listener LN21 and distance $y_{lsn}=y_{lsn2}$ indicative of the position of the listener LN22 indicated by the listener position information, the smaller distance $y_{lsn1}$ is specified as distance $y_{ref}$ indicative of the control point position on the reference line RL21 without change.

In a case where two or more listeners are detected as described above, of these listeners, let the position of the listener nearest to the speaker array 26 in the y direction be the control point position in the y direction, then a wavefront can be formed with good reproducibility at forming a sound field at least at the position of the listener nearest to the speaker array 26.

Further, the reproducibility of a wavefront is lowered as the position gets farther from a control point in the y direction; however, if other listener is near the control point, a wavefront can be formed with sufficient reproducibility also at the positions of these listeners. Moreover, since the position of the listener nearest to the speaker array 26 is specified as the control point position, it can be avoided that no sound field is presented to the listener because of the specification of a control point far from the listener in the y direction from the speaker array 26.

In what follows, the control point specification method in which the position of a listener with the distance in the y direction being nearest to the speaker array 26 is a control point is also especially referred to as a minimum value control point specification method.

Comparison between the listener-by-listener control point specification method and the minimum value control point specification method described above indicates that, in a case where there are two or more listeners and the distance in the x direction between these listeners, namely, the distance in the direction parallel to the direction in which the speakers making up the speaker array 26 are arranged is near, it is more effective to employ the minimum value control point specification method.

For example, in a case where a control point is specified for each of two or more listeners by the listener-by-listener control point specification method so as to have each listener listen to a different sound, the difference in the control point position between listeners requires the generation of a speaker drive signal for each control point. That is, a wavefront for reproducing a predetermined sound with a certain position specified as a control point is generated along with a wavefront for generating another sound with a position different from the position specified as a control point. Then, from the difference in the position in the y direction between these control points, at the position on one control point, an error is caused on the wavefront with the position different from that position formed as a control point.

Hence, if the positions in the x direction of two or more listeners are near each other, for example, a reproduced sound to be listened by a certain listener is leaked to another listener. That is, a listener hears the sound reproduced for that listener together with a sound reproduced for another listener.

On the other hand, in a case where the positions in the x direction of two or more listeners are near each other, then the minimum value control point specification method specifies one control point for these listeners so as to generate a speaker drive signal for reproducing a sound to be listened by each listener with the same position specified as a control point, so that the mixture of sounds at a listener position can be suppressed.

Therefore, it is also practicable for the control point specification unit 23 to select, on the basis of listener position information, one of the specification of a control point by the listener-by-listener control point specification method or the specification of a control point by the minimum value control point specification method, namely, switch between the control point specification methods, thereby specifying a control point.

In such a case, the listener position information includes at least the x-direction position and the y-direction position of each listener. Then, if the x-direction distance between two or more listeners obtained from the listener position information is equal to or less than a predetermined threshold value, for example, the control point is only required to be specified by the minimum value control point specification method. At this time, if the x-direction distance between listeners is greater than the predetermined threshold value, then the control point is specified by the listener-by-listener control point specification method.

It should be noted that if the x-direction distance between listeners is separated to a certain degree, for example, only the speaker just in front of a listener among the speakers making up the speaker array 26 may be used to form a sound field to be presented for that listener.

To be more specific, in the example illustrated in FIG. 5, for example, the speaker drive signal of a sound to be listened by the listener LN21 is generated for only the speakers on the left half of all speakers making up the speaker array 26 as illustrated in FIG. 5, for example, and therefore only these speakers on the left half are used to output the sound.

Use of only the speakers on the left half of the speaker array 26 in front of the listener LN21, namely, use of only the speakers in the proximity of the listener LN21 allows the suppression of the leak of the sound to be listened by the listener LN21 into the other listener LN22.

In this case, only the filter coefficient of each of the speakers on the left half of the speaker array 26 is used so as to generate a speaker drive signal for reproducing a sound to be listened by the listener LN21. As will be described later, the filter coefficient for each of the speakers making up the speaker array 26 is prepared for each control point as the filter coefficient corresponding to one control point in the filter coefficient recording unit 24.

Therefore, in this example, of the filter coefficients of the speakers of the speaker array 26 corresponding to the control points specified for the listener LN21, the filter unit 25 generates a speaker drive signal by using only the filter coefficient of each of the speakers on the left half of the speaker array 26.

By contrast, for the listener LN22, a speaker drive signal of only the speakers on the right half of all the speakers making up the speaker array 26 as illustrated in FIG. 5, for example, is generated and a sound is outputted by use of only the speakers on the right half.

As described above, combining the specification of control points in accordance with the position of a listener and the position of a sound source with the method of selecting speakers for outputting a sound in accordance with the position of a listener allows the forming of a good sound field with less sound leakage.

It should be noted that, in selecting speakers for sounds to be reproduced, not only the position of a listener, namely, listener position information, but also the position of a sound source, namely, sound source position information may be used or only sound source position information may be used. That is, it is sufficient if a speaker is selected in accordance with at least one of the position of a listener and the position of a sound source and, of the filter coefficients corresponding to a specified control point, only the filter coefficient of the selected speaker is used, thereby generating a speaker drive signal.

For example, in a case where speakers are selected on the basis of the position of a listener and the position of a sound source, those located in the proximity of the listener and the sound source are only required to be selected from among the speakers making up the speaker array 26.

Further, in a case where control points are specified by selecting one of the listener-by-listener control point specification method and the minimum value control point specification method, the selection may be executed on the basis of the number of listeners and the distance in the y direction between the listeners or the position of a sound source to be generated, for example. That is, on the basis of at least any one of listener position information and sound source position information, the control point specification methods may be switched in accordance with the position of the listener and the position of the sound source.

For example, in a case where there are many listeners, generating speaker drive signals for two or more listeners and adding these speaker drive signals to provide a final speaker drive signal may make the output sound pressure of each speaker reach the limit of reproducible sound pressure.

In this case, the processing of sound pressure adjustment for controlling the output sound pressure of a speaker within a reproducible sound pressure can easily be executed by specifying one control point for two or more listeners rather than specifying a control point for each of two or more listeners. Therefore, in a case where there are many listeners, namely, in a case where the number of listeners indicated by the listener position information is equal to or higher than a predetermined threshold value, then control point specification may be executed by use of the minimum value control point specification method.

In addition, since the reproducibility of a wavefront is increased as the position is nearer to the reference line, a control point may be specified by the minimum value control point specification method if the distance of the y direction between listeners is equal to or less than a threshold value or by the listener-by-listener control point specification method if the distance in the y direction between listeners is higher than the threshold value, for example.

Further, as examples of control point specification methods, the listener-by-listener control point specification method and the minimum value control point specification method have been described above; however, it is also practicable to specify control points by other methods. Still further, an example in which control points are specified on the basis of only listener position information has been described; however, it is also practicable to specify control points on the basis of only sound source position information or by use of both listener position information and sound source position information.

For example, in a case where control points are specified on the basis of only sound source position information, the position of the y direction of a point sound source indicated by sound source position information may be used as the position of the y direction of the control points.

Further, in a case where a control point is specified by use of both listener position information and sound source position information, for example, any position between the position in the y direction of a point sound source indicated by the sound source position information and the position in the y direction of the listener indicated by the listener position information may be specified as the position in the y direction of the control point.

When a control point is specified and the control point information indicative of the position of the specified control point is generated as described above, the control point information thereof is supplied from the control point specification unit 23 to the filter coefficient recording unit 24.

(The Filter Coefficient Recording Unit)

The filter coefficient recording unit 24 determines, on the basis of control point information, a filter coefficient for use in generating a speaker drive signal from among the filter coefficients of pre-prepared sound filters.

The filter coefficient of a sound filter is obtained as follows by using the SDM method, for example. It should be noted that the details of the SDM method are described in "Sascha Spors and Jens Ahrens, "Reproduction of Focused Sources by the Spectral Division Method," 4th International Symposium on Communications, Control and Signal Processing (ISCCSP), 2010." and so on, for example.

For example, sound field $P(v, n_{tf})$ in a three-dimensional free space is expressed as depicted in equation (1) below.

[Math. 1]

$$P(v,n_{tf})=\int_{\infty}^{-\infty}D(v_0,n_{tf})G(v,v_0,n_{tf})dx_0. \quad (1)$$

It should be noted that, in equation (1) above, $n_{tf}$ is indicative of a time frequency index and v is a vector indicative of a position in the space, namely, v=(x, y, z). Further, in equation (1), $v_0$ is a vector indicative of a predetermined position on the x-axis, namely, $v_0=(x_0, 0, 0)$ In what follows, a position indicated by vector v is also referred to as position v and a position indicated by vector $v_0$ is also referred to as position $v_0$.

Further, in equation (1), $D(v_0, n_{tf})$ is indicative of a drive signal of a secondary sound source and $G(v, v_0, n_{tf})$ is a transfer function between position v and position $v_0$. This secondary sound source drive signal $D(v_0, n_{tf})$ corresponds to a speaker drive signal of a speaker of the speaker array 26.

In the computation by equation (1) mentioned above, the convolution of drive signal $D(v_0, n_{tf})$ and transmission function $G(v, v_0, n_{tf})$ is formed in the space region, in which executing a space Fourier transform on sound field $P(v, n_{tf})$ depicted in equation (1) in the x-axis direction results in equation (2) below.

[Math. 2]

$$P_F(n_{sf},y,z,n_{tf})=D_F(n_{sf},n_{tf})G_F(n_{sf},y,z,n_{tf}) \quad (2)$$

It should be noted that, in equation (2) above, $n_{sf}$ is indicative of a space frequency index.

As described above, when space Fourier transform is executed on sound field $P(v, n_{tf})$, sound field $P_F(n_{sf}, y, z, n_{tf})$ in a space frequency region is expressed by a product between drive signal $D_F(n_{sf}, n_{tf})$ and transmission function $G_F(n_{sf}, y, z, n_{tf})$ in the space frequency region as depicted in equation (2). Therefore, the space frequency expression of the drive signal of a secondary sound source is as depicted in equation (3) below.

[Math. 3]

$$D_F(n_{sf}, n_{tf}) = \frac{P_F(n_{sf}, y, z, n_{tf})}{G_F(n_{sf}, y, z, n_{tf})} \tag{3}$$

Further, in a case where a secondary sound source on a straight line is used, a sound field actually formed only on a control point parallel to that straight line can be matched with an ideal sound field. Therefore, let a position in the y direction of that control point be $y=y_{ref}$ and provide z=0 so as to consider sound field forming on a horizontal plane, then equation (3) becomes as depicted in equation (4) below.

[Math. 4]

$$D_F(n_{sf}, n_{tf}) = \frac{P_F(n_{sf}, y_{ref}, 0, n_{tf})}{G_F(n_{sf}, y_{ref}, 0, n_{tf})} \tag{4}$$

Drive signal $D_F(n_{sf}, n_{tf})$ of a secondary sound source indicated by equation (4) above is a drive signal for forming an ideal sound field at a control point of the position of $y=y_{ref}$.

Further, for a desired sound field $P_F(n_{sf}, y_{ref}, 0, n_{tf})$, point sound source model $P_{ps}(n_{sf}, y_{ref}, 0, n_{tf})$ may be used as depicted in equation (5) below, for example.

[Math. 5]

$$P_{ps}(n_{sf}, y_{ref}, 0, n_{tf}) = S(n_{tf}) \times e^{jk_x x_{ps}} \times \begin{cases} -\frac{j}{4} H_0^{(2)}\left(\sqrt{\left(\frac{\omega}{c}\right)^2 - k_x^2}\,(y_{ref} - y_{ps})\right), & |k_x| < \left|\frac{\omega}{c}\right| \\ \frac{1}{2\pi} K_0\left(\sqrt{k_x^2 - \left(\frac{\omega}{c}\right)^2}\,(y_{ref} - y_{ps})\right), & \left|\frac{\omega}{c}\right| < |k_x| \end{cases} \tag{5}$$

It should be noted that, in equation (5) above, $S(n_{tf})$ is indicative of a sound source signal of a sound to be reproduced, j is indicative of imaginary number unit, and $k_x$ is indicative of the wavenumber in the x-axis direction. Further, $x_{ps}$ and $y_{ps}$ are respectively indicative of the x coordinate and the y coordinate indicative of the positions of point sound sources, ω is indicative of angular frequency, and c is indicative of speed of sound. Still further, $H_0^{(2)}$ is indicative of second-kind Hankel function and $K_0$ is indicative of Bessel function. It should be noted that, since the filter coefficients are not dependent on sound source, $S(n_{tf})=1$ here.

Also, transmission function $G_F(n_{sf}, y_{ref}, 0, n_{tf})$ can be expressed as depicted in equation (6) below.

[Math. 6]

$$G_F(n_{sf}, y_{ref}, 0, n_{tf}) = \begin{cases} -\frac{j}{4} H_0^{(2)}\left(\sqrt{\left(\frac{\omega}{c}\right)^2 - k_x^2}\,y_{ref}\right), & |k_x| < \left|\frac{\omega}{c}\right| \\ \frac{1}{2\pi} K_0\left(\sqrt{k_x^2 - \left(\frac{\omega}{c}\right)^2}\,y_{ref}\right), & \left|\frac{\omega}{c}\right| < |k_x| \end{cases} \tag{6}$$

By use of equation (4), equation (5), and equation (6) mentioned above, space frequency spectrum $D_F(n_{sf}, n_{tf})$ of a speaker drive signal of the speaker array 26 is obtained.

Next, executing space frequency synthesis on space frequency spectrum $D_F(n_{sf}, n_{tf})$ by use of DFT (Discrete Fourier Transform) obtains time frequency spectrum $D(l, n_{tf})$. That is, calculating equation (7) below computes time frequency spectrum $D(l, n_{tf})$.

[Math. 7]

$$D(l, n_{tf}) = \sum_{n_{sf}=0}^{M_{ds}-1} D_F(n_{sf}, n_{tf}) e^{-j\frac{2\pi l n_{sf}}{M_{ds}}} \tag{7}$$

It should be noted that, in equation (7), 1 identifies a speaker making up the speaker array 26 and is indicative of a speaker index indicative of the position of that speaker in the x direction and $M_{ds}$ is indicative of the number of samples of DFT.

Further, time frequency synthesis is executed on time frequency spectrum $D(l, n_{tf})$ by use of IDFT (Inverse Discrete Fourier Transform) to obtain speaker drive signal $d(l, n_d)$ of each speaker of the speaker array 26 that is a time signal. To be more specific, calculation of equation (8) below computes speaker drive signal $d(l, n_d)$.

[Math. 8]

$$d(l, n_d) = \frac{1}{M_{dt}} \sum_{n_{tf}=0}^{M_{dt}-1} D(l, n_{tf}) e^{j\frac{2\pi n_d n_{tf}}{M_{dt}}} \tag{8}$$

It should be noted that, in equation (8) above, $n_d$ is indicative of time index and $M_d t$ is indicative of the number of samples of IDFT. Here, speaker drive signal d(l, nd) is computed for each speaker identified by speaker index 1 of the speaker array 26.

Speaker drive signal $d(l, n_d)$ obtained as described above expresses the filter coefficient itself that is not dependent on sound source. Therefore, replacing time index $n_d$ of this speaker drive signal $d(l, n_d)$ with time index n provides filter coefficient h(l, n) of a sound filter obtained for point sound source position $(x_{ps}, y_{ps})$ and control point position $y=y_{ref}$.

Here, for one control point, filter coefficient h(l, n) is obtained for each speaker identified by speaker index 1 of the speaker array 26. That is, a sound filter is configured from filter coefficient h(l, n) for each speaker making up the speaker array 26.

For example, let a range of a listening area in the y direction in which a sound field is formed be a range from position $y=y_{min}$ (where $0<y_{min}$) to position $y=y_{max}$. In this case, in the filter coefficient recording unit 24, for position $(x_{ps}, y_{ps})$ of a point sound source, filter coefficient h(l, n) of a sound filter with each of two or more positions y in the listening area being a control point is held in advance. That is, for each position $(x_{ps}, y_{ps})$ of a point sound source, filter coefficient h(l, n) for each of positions $y=y_{ref}$ ($y_{min} \leq y_{ref} \leq y_{max}$) of two or more different control points is recorded to the filter coefficient recording unit 24 in advance.

The filter coefficient recording unit 24 selects filter coefficient h(l, n) corresponding to the position of a control point indicated by the control point information supplied from the control point specification unit 23 and supplies the selected coefficient to the filter unit 25. That is, filter coefficient h(l, n) obtained for the position of a control point indicated by the control point information is outputted to the filter unit 25. It should be noted that, in a case where position ($x_{ps}$, $y_{ps}$) of a sound source is not fixed, filter coefficient h(l, n) only has to be selected on the basis of the sound source position indicated by the sound source position information obtained in the sound source position acquisition unit 22 and the position of a control point indicated by the control point information.

(The Filter Unit)

Sound source signal x(n) of a sound to be reproduced is supplied to the filter unit 25. Here, n in sound source signal x(n) is indicative of a time index.

The filter unit 25 convolutes supplied sound source signal x(n) with filter coefficient h(l, n) supplied from the filter coefficient recording unit 24 so as to obtain speaker drive signal d(l, n). That is, in the filter unit 25, equation (9) below is calculated for each speaker making up the speaker array 26 so as to compute speaker drive signal d(l, n) of each speaker identified by speaker index 1.

[Math. 9]

$$d(l, n) = \sum_{k=0}^{N} h(l, k)x(n-k) \tag{9}$$

It should be noted that, in equation (9) above, N is indicative of the filter length of a sound filter.

Further, in a case where two or more control points different in the position of the y direction are specified in the control point specification unit 23, then filter coefficient h(l, n) is supplied from the filter coefficient recording unit 24 to each of the control points different in the position in the y direction. In such a case, the filter unit 25 obtains speaker drive signal d(l, n) for each of the control points different in the position in the y direction and adds, for each speaker, speaker drive signals d(l, n) obtained for each of the control points, thereby providing a final speaker drive signal.

The filter unit 25 supplies the final speaker drive signal obtained as described above to the speaker array 26.

<The Description of Sound Field Forming Processing>

Figure 6:
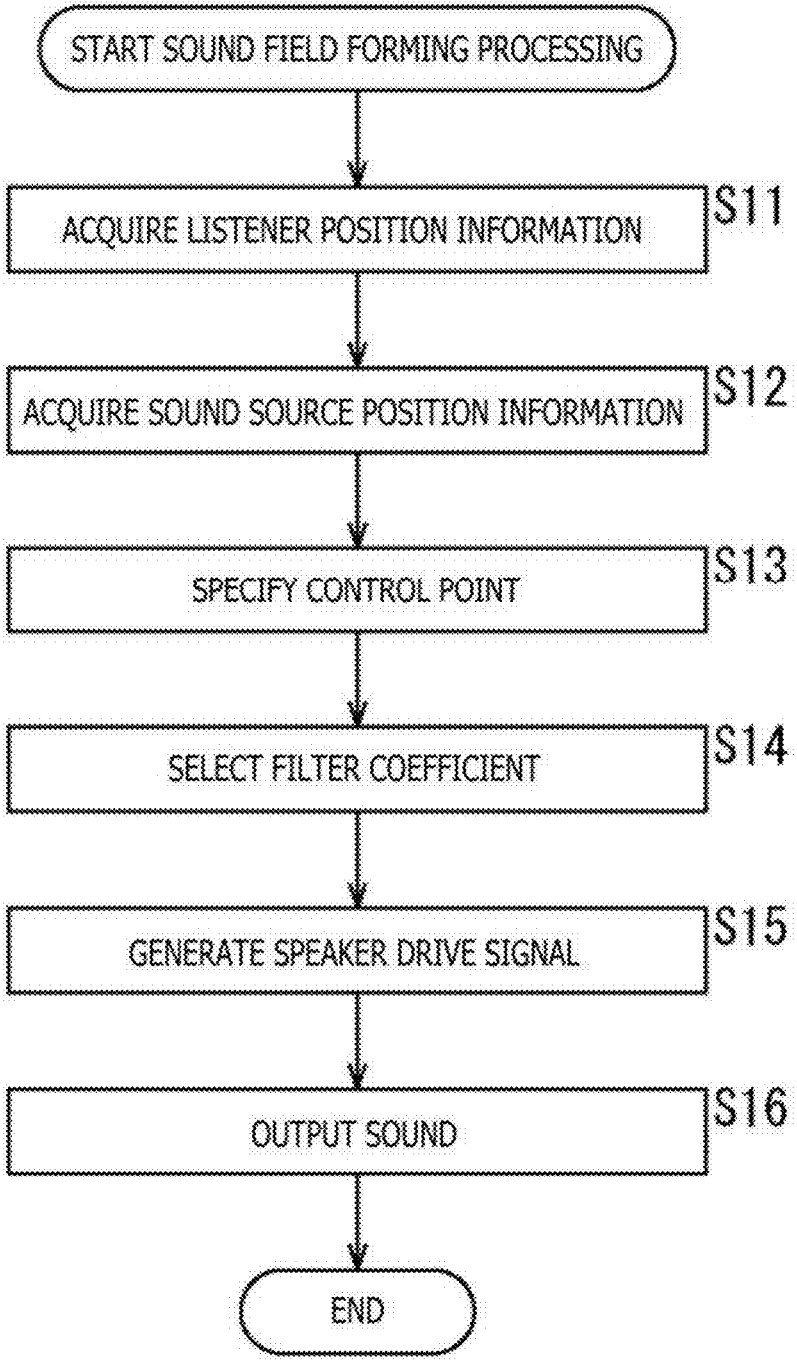
FIG. 6 is a flowchart indicative of sound field forming processing.

The following describes an operation of the sound field forming apparatus 11 described above. That is, the following describes the sound field forming processing to be executed by the sound field forming apparatus 11 with reference to the flowchart illustrated in FIG. 6.

In step S11, the listener position acquisition unit 21 acquires listener position information and supplies the acquired listener position information to the sound source position acquisition unit 22 and the control point specification unit 23.

In step S11, distance $y_{lsn}$ in the y direction from the speaker array 26 to the listener supplied from an external apparatus or inputted by the user, for example, is acquired as listener position information. Further, for example, distance $y_{lsn}$ may also be acquired by the object recognition of an image taken by a camera as the listener position acquisition unit 21 or the detection of the listener with a pressure sensor as the listener position acquisition unit 21.

In step S12, the sound source position acquisition unit 22 acquires sound source position information and supplies the acquired sound source position information to the control point specification unit 23.

For example, in step S12, a sound source position is obtained on the basis of the listener position information supplied from the listener position acquisition unit 21 to the sound source position acquisition unit 22 or a sound source position inputted from the outside is used so as to generate the information indicative of the sound source, thereby providing sound source position information.

In step S13, the control point specification unit 23 specifies one or more control points on the basis of the listener position information supplied from the listener position acquisition unit 21 and the sound source position information supplied from the sound source position acquisition unit 22 and supplies the control point information indicative of the position or positions of the specified one or more control points to the filter coefficient recording unit 24.

For example, the control point specification unit 23 specifies a control point by use of the listener-by-listener control point specification method or the minimum value control point specification method described above. That is, one or more control points mutually different in the positions in the y direction are determined. Further, it is also practicable for the control point specification unit 23 to select one of the listener-by-listener control point specification method and the minimum value control point specification method on the basis of the listener position information so as to specify control points by the selected control point specification method, for example.

In step S14, the filter coefficient recording unit 24 selects a filter coefficient on the basis of the control point information supplied from the control point specification unit 23 and supplies the selected filter coefficient to the filter unit 25.

For example, in step S14, a filter coefficient corresponding to the position of the control point specified by the control point information is selected. At this moment, in a case where two or more control points different in the position in the y direction are specified, a filter coefficient is selected for each of these control points.

In step S15, the filter unit 25 convolutes the filter coefficient supplied from the filter coefficient recording unit 24 with a sound source signal supplied from the outside, thereby generating a speaker drive signal. To be more specific, the calculation of equation (9) above is executed so as to generate a speaker drive signal of each speaker for each control point and, for each speaker, the speaker drive signals for the control points are added up, thereby providing a final speaker drive signal.

The filter unit 25 supplies the speaker drive signal thus obtained to each speaker of the speaker array 26.

In step S16, the speaker array 26 outputs a sound on the basis of the speaker drive signal supplied from the filter unit 25 so as to form a desired sound field, upon which the sound field forming processing ends.

As described above, the sound field forming apparatus 11 acquires listener position information and sound source position information so as to specify control points on the basis of the acquired listener position information and sound source position information. Consequently, the reproducibility of the wavefront at a listener position can be enhanced by specifying a control point for each listener or specifying one control point for two or more listeners, for example.

Application Example 1 of the Present Technology

<Example in which a Linear Microphone Array is Used>

The following describes a specific application example of the present technology as described above.

Figure 7:
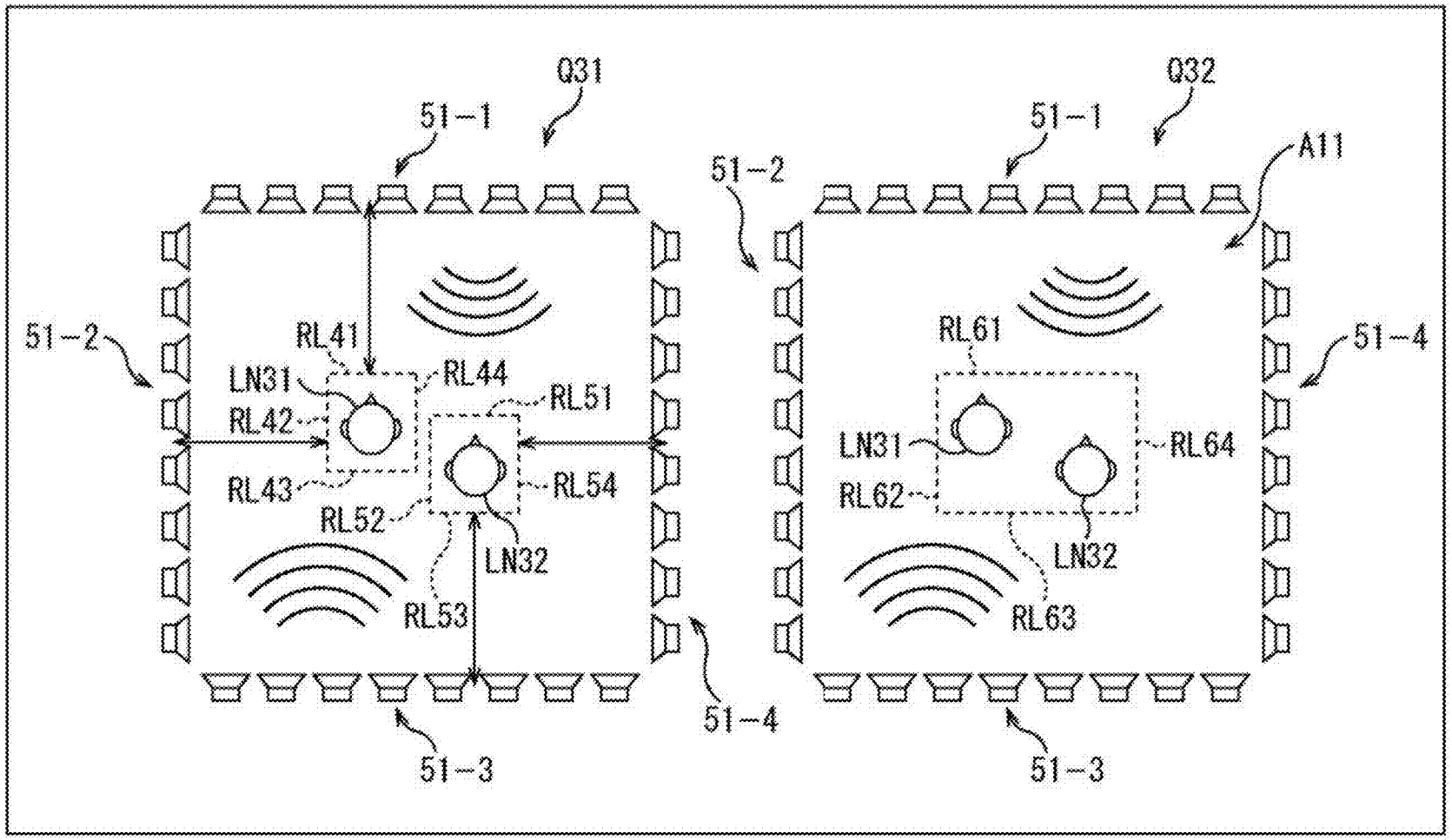
FIG. 7 is a diagram describing an example of an application of the present technology.

For example, the present technology is also applicable in a case where a listening area is a region that is enclosed by four speaker arrays, a speaker array 51-1 through a speaker array 51-4 as illustrated in FIG. 7.

In this example, the speaker array 51-1 through the speaker array 51-4 are linear speaker arrays with a listener LN31 and a listener LN32 being in the listening area. That is, the four speaker arrays, the speaker array 51-1 through the speaker array 51-4 are arranged so as to surround the listener LN31 and the listener LN32 positioned in the listening area.

It should be noted that, in a case where there is no special need for discriminating the speaker array 51-1 through the speaker array 51-4 from each other, these speaker arrays are generically referred to simply as the speaker array 51. One speaker array 51 corresponds to the speaker array 26 in the sound field forming apparatus 11 illustrated in FIG. 2.

In such a case, the sound field forming apparatus has a configuration of the components, the listener position acquisition unit 21 through the filter unit 25, for each speaker array 51, for example.

For example, in a case where a sound is outputted by use of the four speaker arrays 51 so as to form a sound field by wavefront synthesis, regarding each speaker array 51, specifying a control point for each listener by the listener-by-listener control point specification method positions each listener into a region enclosed by the reference lines for each speaker array 51 as indicated with arrow Q31.

That is, the listener LN31, for example, is enclosed by a reference line RL41 including control points specified for the speaker array 51-1, a reference line RL42 including control points specified for the speaker array 51-2, a reference line RL43 including control points specified for the speaker array 51-3, and a reference line RL44 including control points specified for the speaker array 51-4.

Thus, since the listener LN31 is in the region enclosed by the reference line RL41 through the reference line RL44, namely, is positioned in the proximity of these reference lines, a wavefront of sound is formed with high reproducibility at the position of the listener LN31.

Likewise, the listener LN32, for example, is enclosed by a reference line RL51 including control points specified for the speaker array 51-1, a reference line RL52 including control points specified for the speaker array 51-2, a reference line RL53 including control points specified for the speaker array 51-3, and a reference line RL54 including control points specified for the speaker array 51-4.

Further, if one control point is specified for two or more listeners by the minimum value control point specification method described above for each speaker array 51, then all listeners are positioned in the same region enclosed by the reference lines for each speaker array 51 as indicated with arrow Q32.

That is, the listener LN31 and the listener LN32, for example, are enclosed by a reference line RL61 including control points specified for the speaker array 51-1, a reference line RL62 including control points specified for the speaker array 51-2, a reference line RL63 including control points specified for the speaker array 51-3, and a reference line RL64 including control points specified for the speaker array 51-4.

In this case, since the listener LN31 and the listener LN32 are in the region enclosed by the reference line RL61 through the reference line RL64, a wavefront of sound is formed with high reproducibility at the positions of these listeners.

Further, in a case where a focus point sound source is generated by the SDM method, for example, the sound source cannot be generated at a position far from a reference line or control points, as viewed from the speaker array 51. Still further, a position far from a listener as viewed from the speaker array 51 cannot be specified as the position of a control point. Therefore, it is required to specify a sound source position and control point position such that the conditions for these sound source and control point are satisfied.

Therefore, for example, in a case where a sound source is generated at a position indicated with arrow A11 at the time of sound field forming, the sound source is generated by the speaker array 51-1 and the speaker array 51-4 without using the speaker array 51-2 and the speaker array 51-3 for generating this sound source.

Application Example 2 of the Present Technology

<Example in which a Ring Microphone Array is Used>

With reference to FIG. 7, an example in which a linear microphone array is used has been described; however, as described above, a microphone array may be a ring microphone array or a spherical microphone array.

Figure 8:
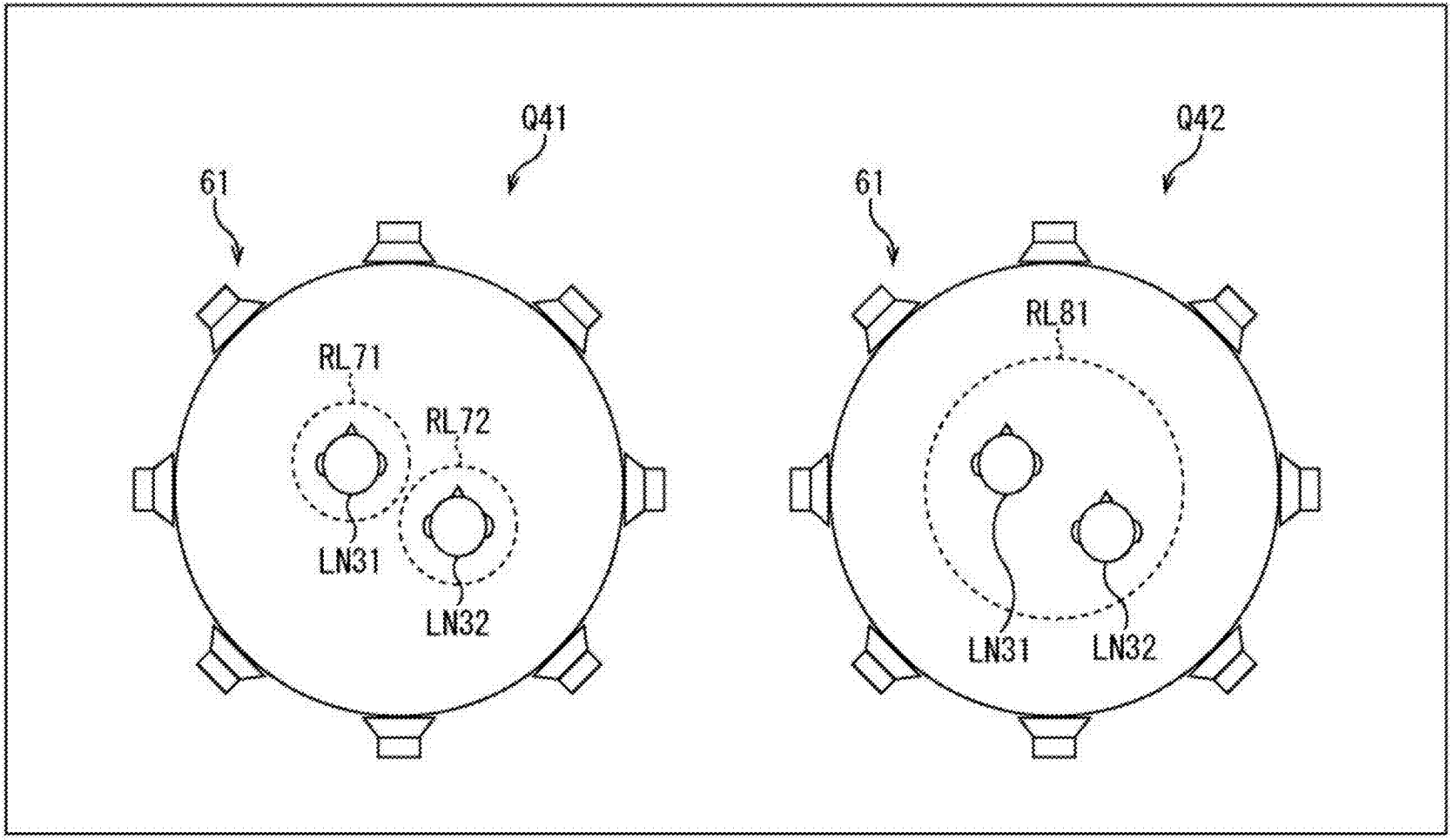
FIG. 8 is a diagram describing an example of another application of the present technology.

For example, also in a case where a ring microphone array is used, it is also practicable to specify control points by use of the listener-by-listener control point specification method or the minimum value control point specification method as illustrated in FIG. 8. It should be noted that, with reference to FIG. 8, components similar to those previously described with reference to FIG. 7 are denoted by the same reference symbols and the description thereof will be skipped.

In this example, a speaker array 61 is a ring speaker array with speakers arranged in a circle, or a ring. This speaker array 61 corresponds to the speaker array 26 in the sound field forming apparatus 11 illustrated in FIG. 2. In addition, a circular region enclosed by the speaker array 61 is a listening area in which there are two listeners, the listener LN31 and the listener LN32.

For example, in a case where a sound field is formed by outputting a sound by use of the speaker array 61, specifying a control point for each listener by the listener-by-listener control point specification method described above, positions each listener into a region enclosed by reference lines as indicated with arrow Q41.

That is, the listener LN31, for example, is positioned inside a circular reference line RL71 including the control points specified for that listener LN31. Likewise, the listener LN32 is positioned inside a circular reference line RL72 including the control points specified for that listener LN32.

By contrast, specifying one control point for two or more listeners by the minimum value control point specification method described above, positions all listeners into the inside of a circular reference line RL81 including the specified control point as indicated with arrow Q42.

In such a case, if a focus point sound source is generated by the SDM method, for example, the focus point sound source only has to be generated at a position between the speaker array 61 and the reference line.

<Configurational Example of a Computer>

Meanwhile, the sequence of processing operations described above can be executed by hardware as well as software. For the execution of the sequence of processing operations by software, the programs making up that software are installed in a computer. It should be noted that the computer includes a computer assembled in dedicated hardware or a general-purpose personal computer, for example, capable of executing various functions by installing various programs.

Figure 9:
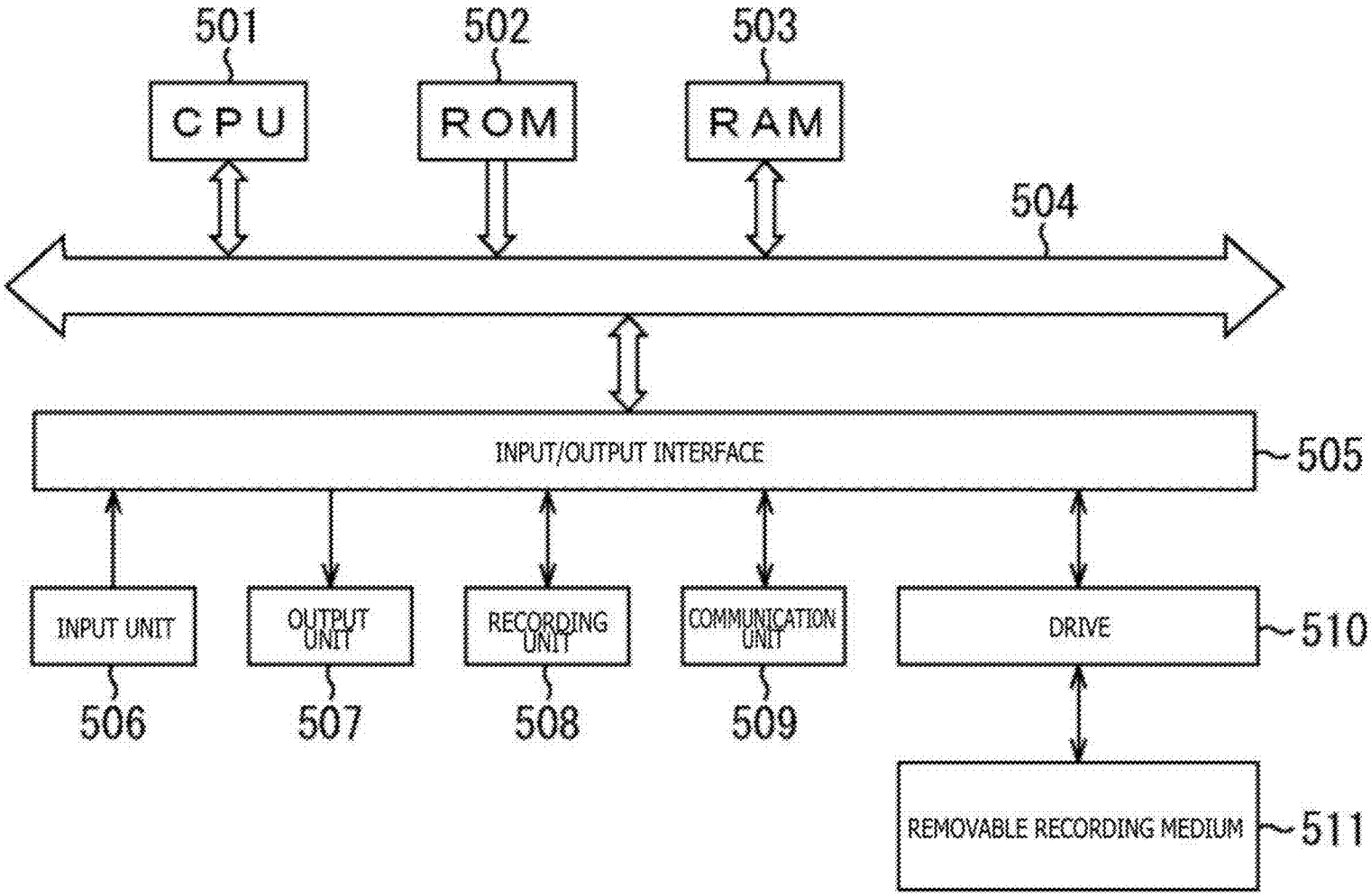
FIG. 9 is a diagram illustrating a configurational example of a computer.

FIG. 9 is a block diagram illustrating the hardware configuration example of a computer for executing the sequence of processing operations by programs described above.

In the computer, a CPU (Central Processing Unit) 501, a ROM (Read Only Memory) 502, and a RAM (Random Access Memory) 503 are interconnected by a bus 504.

The bus 504 is further connected to an input/output Interface 505. The input/output interface 505 is connected to an input unit 506, an output unit 507, a recording unit 508, a communication unit 509, and a drive 510.

The input unit 506 includes a keyboard, a mouse, a microphone, an image sensor, and the like. The output unit 507 includes a display, a speaker array, and the like. The recording unit 508 includes a hard disk drive, a nonvolatile memory, and the like. The communication unit 509 includes a network interface and the like. The drive 510 drives a removable recording medium 511 such as a magnetic disk, an optical disk, a magneto-optical disk, a semiconductor memory, or the like.

In the computer configured as described above, the CPU 501, for example, loads programs recorded in the recording unit 508 into the RAM 503 via the input/output interface 505 and the bus 504 and executes the loaded programs so as to execute the sequence of processing operations described above.

The programs to be executed by the computer (the CPU 501) can be provided as recorded to the removable recording medium 511 as package medium and the like, for example. In addition, the programs can be provided via wired or wireless transmission media such as a local area network, the Internet, and digital satellite broadcasting.

In the computer, programs can be installed in the recording unit 508 via the input/output interface 505 by loading the removable recording medium 511 onto the drive 510. Further, programs can be received by the communication unit 509 via wired or wireless transmission media so as to be installed in the recording unit 508. In addition, programs can be installed in the ROM 502 or the recording unit 508 in advance.

It should be noted that the programs to be executed by the computer may be the programs that are executed in time sequence along the sequence described herein or the programs that are executed in parallel as required on an on-demand basis.

It should be noted that the embodiments of the present technology are not limited to the embodiments described above and therefore changes and variations may be made to the embodiments without departing from the spirit of the present technology.

For example, the present technology can take a configuration of a cloud computer in which one function is dividedly and jointly processed by two or more apparatuses through a network.

Each step described in the flowcharts described above can be executed on one apparatus or on two or more apparatuses in a divided manner.

Further, in a case where two or more processing operations are included in one step, the two or more processing operations included in that one step can be executed by one apparatus or two or more apparatuses in a divided manner.

It should be noted that the effects described herein are illustrative only and therefore not limited thereto; namely, other effects may be provided.

Further, the present technology can also take the following configuration.

(1) A sound field forming apparatus including:

a position acquisition unit configured to acquire position information indicative of a position of a listener or a position of a sound source to be formed;

a control point specification unit configured to specify a control point in accordance with a distance from a speaker array of the listener or the sound source on a basis of the position information; and a filter unit configured to generate a speaker drive signal for forming a predetermined sound field by the speaker array by convoluting a filter coefficient corresponding to the specified control point with a sound source signal.

(2) The sound field forming apparatus cited in (1) above, in which the control point specification unit specifies the control point in accordance with a distance from the speaker array of the listener for each of a plurality of the listeners.

(3) The sound field forming apparatus cited in (1) above, in which the control point specification unit specifies the control point in accordance with a distance from the speaker array of the listener nearest from the speaker array among a plurality of the listeners.

(4) The sound field forming apparatus cited in (2) above, in which the control point specification unit specifies the control point by switching between the specification of the control point for each of the plurality of listeners on the basis of the position information and the specification of the control point in accordance with a distance from the speaker array of the listener nearest from the speaker array among the plurality of listeners.

(5) The sound field forming apparatus cited in (4), in which, in a case where a distance between the plurality of listeners is equal to or less than a predetermined threshold value, the control point specification unit specifies the control point in accordance with a distance from the speaker array of the listener nearest from the speaker array among the plurality of listeners.

(6) The sound field forming apparatus cited in any one of (1) through (5) above, in which the speaker array is arranged so as to surround the listener.

(7) The sound field forming apparatus cited in any one of (1) through (6) above, further including: the speaker array.

(8) The sound field forming apparatus cited in any one of (1) through (7) above, further including:

a filter coefficient recording unit configured to record each of the filter coefficients corresponding to a plurality of the control points.

(9) The sound field forming apparatus cited in any one of (1) through (8) above, in which, from among the filter coefficients of speakers making up the speaker array corresponding to the specified control point, the filter unit generates the speaker drive signal by use of only the filter coefficient of a speaker in accordance with the position of the sound source or the position of the listener.

(10) A sound field forming method including the steps of:

acquiring position information indicative of a position of a listener or a position of a sound source to be formed;

specifying a control point in accordance with a distance from a speaker array of the listener or the sound source on a basis of the position information; and generating a speaker drive signal for forming a predetermined sound field by the speaker array by convoluting a filter coefficient corresponding to the specified control point with a sound source signal.

(11) A program for having a computer execute processing including the steps of:

acquiring position information indicative of a position of a listener or a position of a sound source to be formed;

specifying a control point in accordance with a distance from a speaker array of the listener or the sound source on a basis of the position information; and generating a speaker drive signal for forming a predetermined sound field by the speaker array by convoluting a filter coefficient corresponding to the specified control point with a sound source signal.

REFERENCE SIGNS LIST

11 . . . Sound field forming apparatus, 21 . . . Listener position acquisition unit, 22 . . . Sound source position acquisition unit, 23 . . . Control point specification unit, 24 . . . Filter coefficient recording unit, 25 . . . Filter unit, 26 . . . Speaker array

The invention claimed is:

1. An apparatus, comprising:

a central processing unit (CPU) configured to:

acquire position information indicative of one of a position of a first listener of a plurality of listeners or a position of a sound source;

determine a control point position based on:

a first distance of one of the first listener or the sound source from a speaker array, and the acquired position information, wherein the speaker array surrounds the first listener;

convolve a filter coefficient, corresponding to the determined control point position, with a sound source signal;

generate a speaker drive signal based on the convolution of the filter coefficient with the sound source signal; and control the speaker array to generate a specific sound field, wherein the specific sound field is generated based on the speaker drive signal.

2. The apparatus according to claim 1, wherein the CPU is further configured to determine the control point position based on a second distance of each of the plurality of listeners from the speaker array.

3. The apparatus according to claim 2, wherein the CPU is further configured to switch between:

determination of the control point position for each of the plurality of listeners based on the acquired position information, and determination of the control point position based on a third distance of a second listener of the plurality of listeners from the speaker array, and the second listener is nearest to the speaker array among the plurality of listeners.

4. The apparatus according to claim 3, wherein the CPU is further configured to determine the control point position based on a fourth distance between the plurality of listeners, and the fourth distance is one of equal to or less than a threshold value.

5. The apparatus according to claim 1, wherein the CPU is further configured to determine the control point position based on a second distance of a second listener of the plurality of listeners from the speaker array, and the second listener is nearest to the speaker array among the plurality of listeners.

6. The apparatus according to claim 1, further comprising the speaker array.

7. The apparatus according to claim 1, wherein the CPU is further configured to record a plurality of filter coefficients corresponding to a plurality of control points.

8. The apparatus according to claim 1, wherein the CPU is further configured to generate the speaker drive signal, by utilization of the filter coefficient from among a plurality of filter coefficients, based on the one of the position of the first listener or the position of the sound source, and the plurality of filter coefficients corresponds to:

a plurality of speakers of the speaker array, and the determined control point position.

9. A method, comprising:

acquiring position information indicative of one of a position of a listener or a position of a sound source;

determining a control point position based on:

a distance of one of the listener or the sound source from a speaker array, and the acquired position information, wherein the speaker array surrounds the listener;

convoluting a filter coefficient, corresponding to the determined control point position, with a sound source signal;

generating a speaker drive signal based on the convolution of the filter coefficient with the sound source signal; and controlling the speaker array to generate a specific sound field, wherein the specific sound field is generated based on the speaker drive signal.

10. A non-transitory computer-readable medium having stored thereon computer-executable instructions which, when executed by a computer, cause the computer to execute operations, the operations comprising:

acquiring position information indicative of one of a position of a listener or a position of a sound source;

determining a control point position based on:

a distance of one of the listener or the sound source from a speaker array, and the acquired position information, wherein the speaker array surrounds the listener;

convoluting a filter coefficient, corresponding to the determined control point position, with a sound source signal;

generating a speaker drive signal based on the convolution of the filter coefficient with the sound source signal; and controlling the speaker array to generate a specific sound field, wherein the specific sound field is generated based on the speaker drive signal.

* * * * *